United States Patent [19]

Thompson

[11] 3,969,070

[45] July 13, 1976

[54] CLOTHES DRYER WITH HEAT RECLAIMER

[75] Inventor: Richard D. Thompson, Cincinnati, Ohio

[73] Assignee: McGraw-Edison Company, Elgin, Ill.

[22] Filed: Feb. 12, 1975

[21] Appl. No.: 549,167

[52] U.S. Cl. ..... 432/105; 432/107; 34/86; 34/131; 34/133

[51] Int. Cl.[2] ..... F27B 7/36

[58] Field of Search ..... 34/35, 86, 131, 132, 34/133, 139; 432/105, 107, 103

[56] References Cited

UNITED STATES PATENTS

| | | | |
|---|---|---|---|
| 2,867,430 | 1/1959 | Hullar | 432/107 |
| 3,624,919 | 12/1971 | Miller | 34/133 |
| 3,831,294 | 8/1974 | Freze | 34/133 |
| 3,861,865 | 1/1975 | Grantham | 34/133 |

*Primary Examiner*—Kenneth W. Sprague
*Assistant Examiner*—James C. Yeung
*Attorney, Agent, or Firm*—Charles F. Lind

[57] ABSTRACT

The dryer under consideration has a gas burner located within a sheet metal housing, and passageways in and through the housing direct ambient air for combustion with fuel within the housing and subsequent discharge of the combined combustion gases through the inlet opening into the drum chamber. The exhaust opening from the drum chamber is ducted to the outside atmosphere but it is also ducted at a tee junction to a reclaimer housing that directs this diverted gas in heat exchange relation past the burner housing and to the drum chamber. Thus, a portion of such exhausted gases is reused, preferrably the reused gas should constitute approximately 50 to 70 percent of the total volume of gas used, and it is heated only by heat exchange contact with the burner housing; while the remainder of the drying gases comprises the ambient air heated by combustion in the burner with the gaseous fuel and is thus much hotter. The orientation of the inlet openings to the drum chamber for the combustion and recycled gases provides that the hotter combustion gases be discharged on the upstream side of the cooler recycled gases, as referenced by the direction of rotation of the dryer drum and its tangential effect pass the inlet openings; and these openings are immediately adjacent one another.

4 Claims, 4 Drawing Figures

CLOTHES DRYER WITH HEAT RECLAIMER

This invention relates to a laundry dryer exhaust gas recirculating means effectively used for improving the overall drying capacity of the dryer with a given BTU heat input and/or for otherwise generally improving the operating efficiency of the unit.

Because of the pronounced fuel shortages, potential or real, efforts have been directed to improve the operating efficiencies of energy consuming units including laundry dryers. In a typical laundry dryer, an exterior shell or housing defines a chamber within which a perforated drum is rotated, and spaced openings in the shell define an air flow path for drying air passing through the drum and the laundry goods tumbling freely therein. An air heating device typically located in the air flow path upstream of the inlet opening heats the air to a suitable drying temperature and the exhaust opening is connected by ducts to the outdoor atmosphere. Various attempts for reclaiming heat in the exhaust gases have been made in an effort to save fuel and economize on the dryer operation, and this invention relates to a means which has proved most successful.

In the dryer under consideration, a gas burner is located within a sheet metal housing, and passageways in and through the housing direct ambient air for combustion with fuel within the housing and subsequent discharge of the combined combustion gases through the inlet opening into the drum chamber. The exhaust opening from the drum chamber is ducted to the outside atmosphere but it is also ducted at a tee junction back in heat exchange relation past the burner housing and to the drum chamber. Thus, a portion of such exhausted gases is reused, preferrably the reused gas should constitute approximately 50 to 70 percent of the total volume of gas used, and it is heated only by heat exchange contact with the burner housing; while the remainder of the drying gases comprises the ambient air heated by combustion in the burner with the gaseous fuel. The burner combustion gases are at approximately 600° to 750°F; the exhausted gases at the reclaimer inlet are slightly above ambient temperature, such as 100°F to possible 160°F, but are reheated before discharge to the drum chamber by the burner housing to approximately 220° to 300°F; and these combustion and reclaimed gases are then discharged into the drum chamber in close mixing proximity to one another.

The orientation of the inlet openings to the drum chamber for the burner and the recycled gases is important, and provides that the hotter burner gases be discharged on the upstream side of the cooler recycled gases, as referenced by the direction of rotation of the dryer drum and its tangential effect pass the inlet openings; and these openings are immediately adjacent one another. This provides for thorough mixing of the gases to minimize over temperature scorching of the tumbling laundry articles. Moreover, the gases are directed from properly sized respective inlet openings normal to the circumferential perforated drum wall to provide good penetration to the drum interior, thereby minimizing air slip in effect around the inside of the shell exteriorly of the drum. In order for the invention to be fully appreciated, reference is made to the following specification, the accompanying drawings forming a part thereof, wherein:

Figure 4:
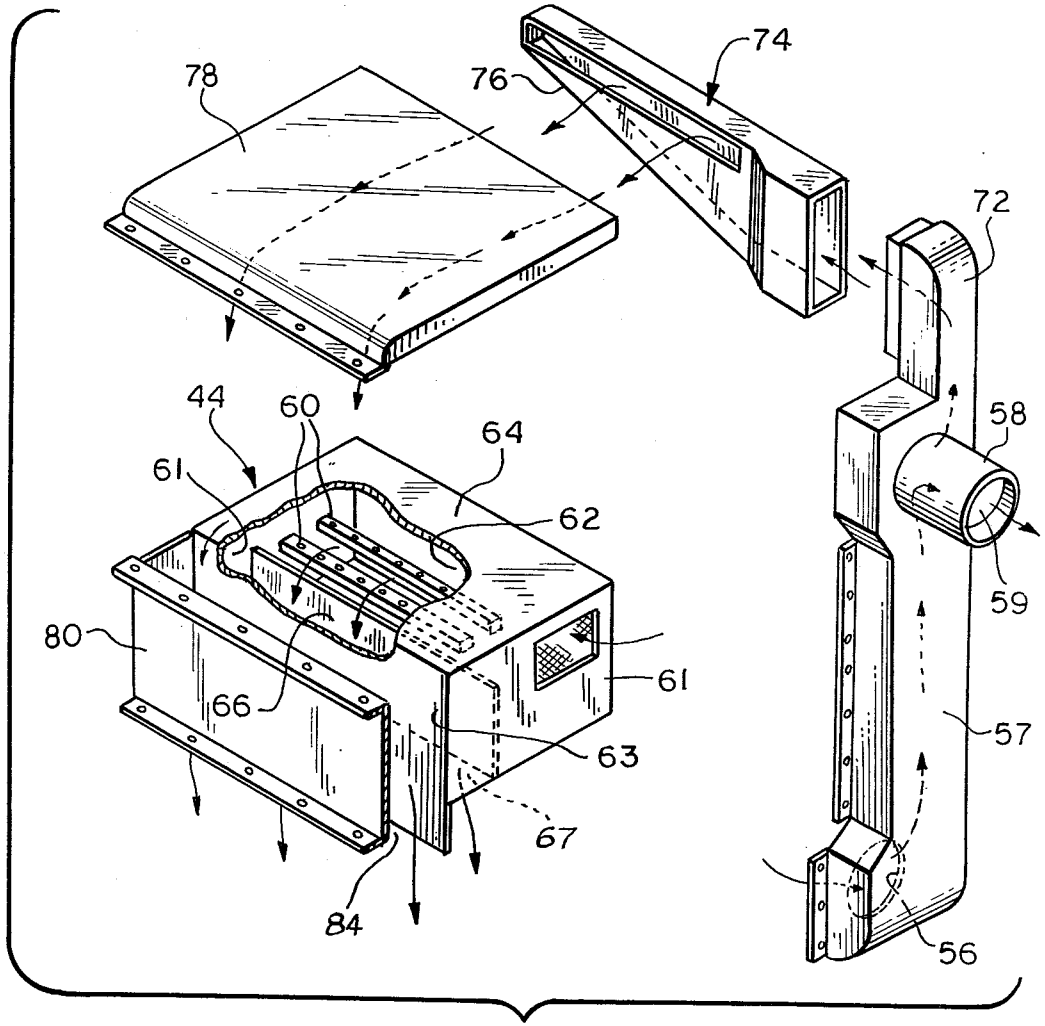
FIG. 4 is an exploded perspective view of the burner and gas reclaiming housing structures as well as the exhaust gas duct connection to these structures.
Figure 1:
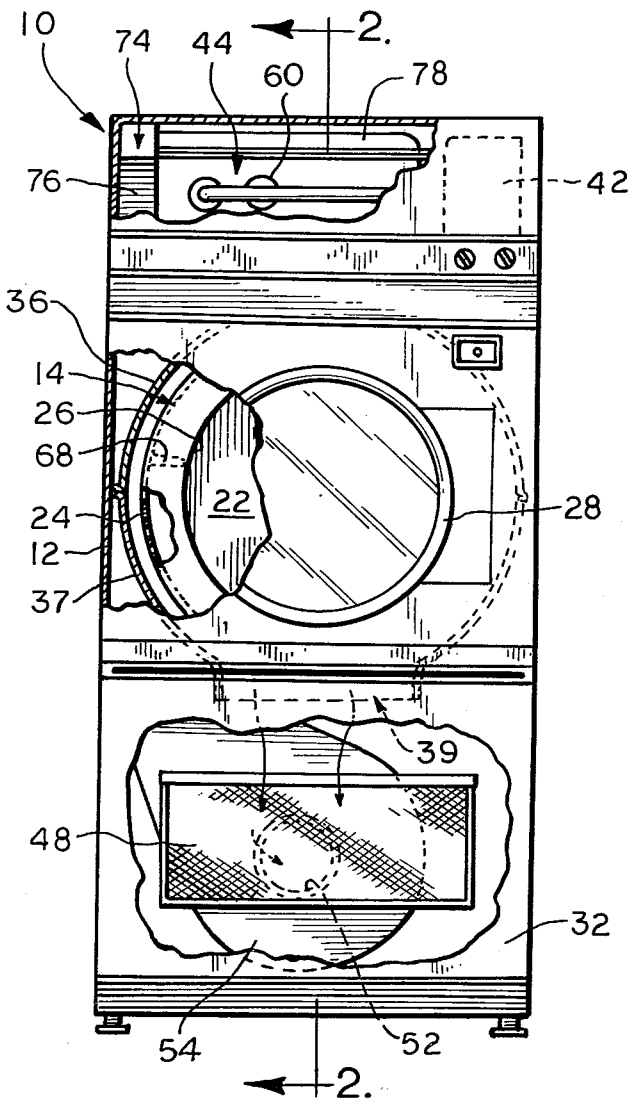
FIG. 1 is a front elevational view of a typical dryer, partly broken away and shown in section, showing the basic working componants of a dryer and the incorporation therein of the subject invention.
Figure 3:
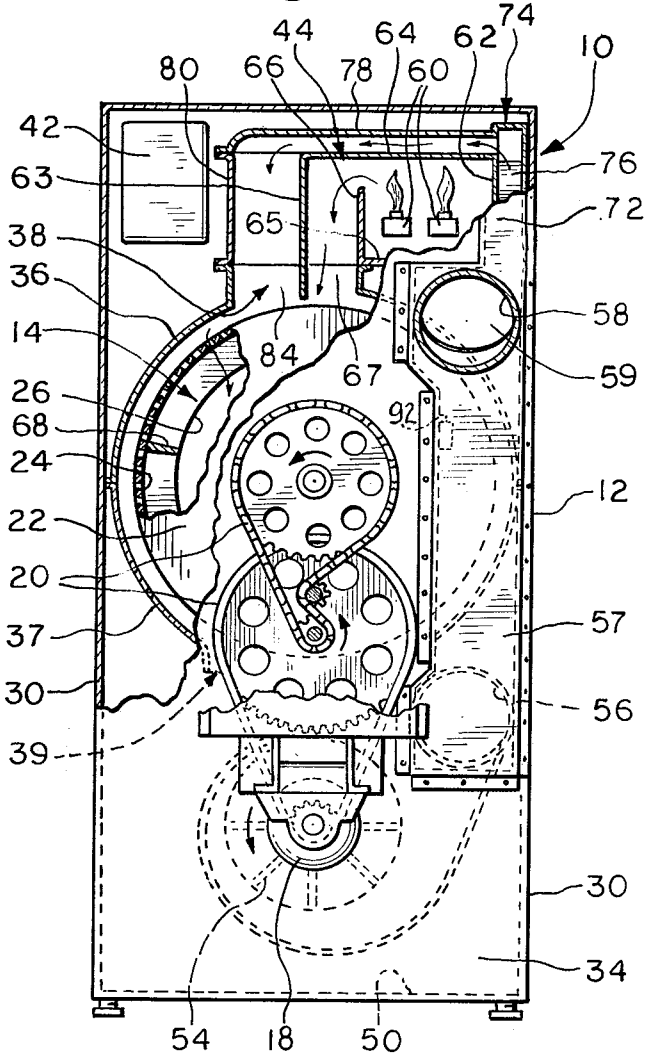
FIG. 3 is a rear elevational view, partly in section, generally from line 3—3 in FIG. 2.
Figure 2:
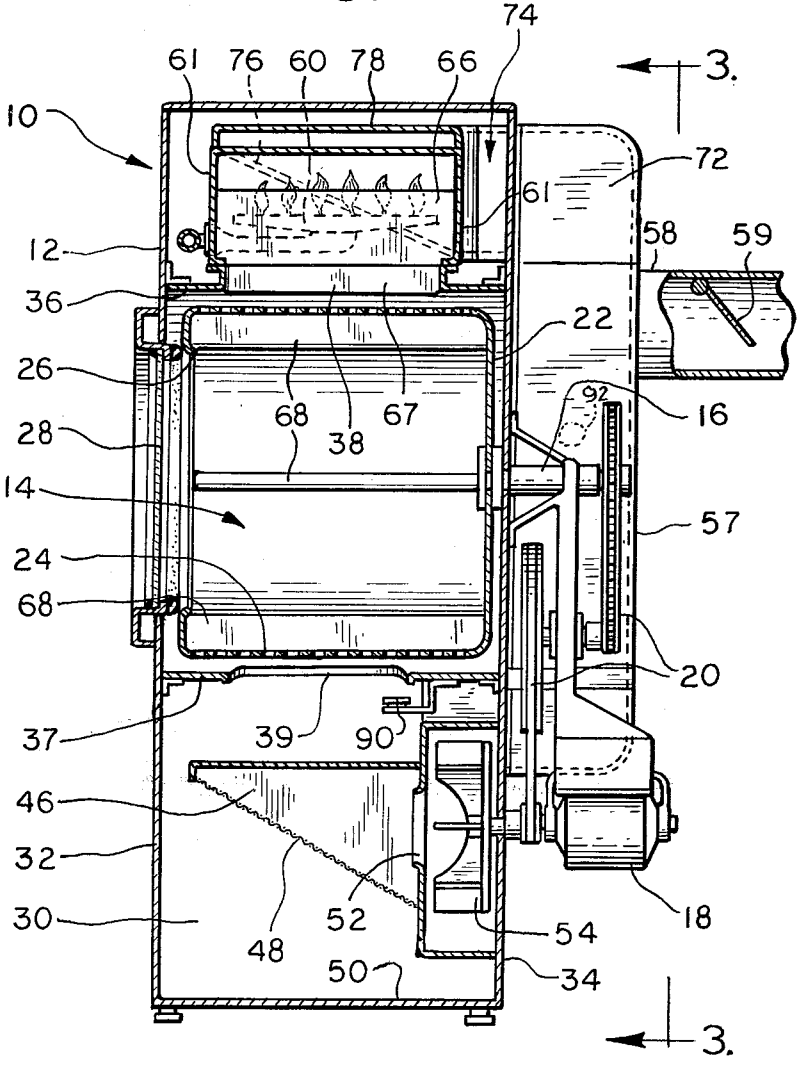
FIG. 2 is a sectional view as seen generally from line 2—2 in FIG. 1, showing a dryer construction made according to subject invention.

The dryer 10 shown has an exterior sheet metal housing or shell 12 and a perforated drum 14 is supported by a shaft cantilevered within bearing 16 secured on the housing rear wall to rotate within the housing. An electric motor 18 is used with an appropriate drive 20 to rotate the drum slowly within the housing. In typical construction, the rear drum wall 22 is solid and is connected to the drum shaft, the circumferential drum wall 24 is perforated to allow for the through passage of air, and the drum front wall 26 is annular leaving a large central opening. The dryer housing has an access opening aligned with the drum opening thereby allowing for the loading and unloading of the drum; and a door 28 hinged to the housing front wall closes the access opening.

The housing 12 including a pair of side walls 30, the front wall 32 and closure door 28, and the rear wall 34 provides for a tubular like air confinement or chamber about the drum. These walls can be insulated to minimize heat loss from the drum chamber. The housing 12 also has air flow baffle walls 36 and 37 which extend crosswise of the tubular shell on the upper and lower sides of the drum and are curved to be concentrically spaced from the drum, and the walls have openings 38 and 39 respectively immediately adjacent the drum. The housing enclosure above the upper air baffle wall 36 and corresponding opening 38 is suited for locating a dryer control console 42 and a burner housing 44, and the housing enclosure below the lower air baffle wall 37 and corresponding opening 39 is suited for locating a lint trap. The lint trap shown has an upper frame 46 supporting an underlying flexible fine mesh screen 48 above the housing base wall 50 where the screen surrounds the return opening 52 to a blower unit 54. The blower unit discharge outlet 56 opens to a duct 57 for discharge out exhaust duct 58 exteriorily of the dryer housing, typically to the outdoor atmosphere. A damper 59 in the exhaust duct 58 automatically prevents gas blowback of the outside atmospheric air into the dryer when the same is not in use.

The burner unit 44 typically includes at least one horizontal gas burner tube 60 housed within a sheet metal enclosure defined by spaced end walls 61, spaced side walls 62 and 66, and spaced top wall 64 and bottom wall 65. The open upper part of the rear dryer housing wall and appropriate openings in the burner housing end wall 61 or side wall 62 allows fresh ambient air passage to support combustion above the burner tube in the burner housing 44. The gases from the burner housing are discharged around side wall 66 and between spaced end walls 61 and divider wall 63 through a passage to opening 67 formed as part of upper baffle wall opening 38 to the dryer drum.

The normal air flow passage through the dryer would be across the openings 38 and 39 through the perforated drum walls from or through the burner housing 44 and through the lint trap screen and fan means 54 and out the exhaust duct 58. Inwardly extended drum paddles 68, which are typical in the art, cause the laundry goods to tumble upon drum rotation, and the downward passage of heated air through the tumbling goods effectively draws moisture from the goods.

This invention represents a successful construction for and manner of recycling part of the exhaust gas through the dryer for improved dryer operation. In this regard, the duct 57 extends past the exhaust outlet duct 58 and connects through duct 72 to a manifold 74 located in adjacent proximity to the burner housing 44. The recycle manifold 74 is formed by wall structure 76 connected between burner housing end walls 61 and preferably at an angle to vary the effective interior manifold area from the largest at the manifold inlet to its smallest at the manifold terminal end. The housing top wall 78 extends in spaced proximity above the burner housing top wall 64 to wall 80 which extends in spaced proximity next to burner divider wall 63. This defines an air flow passage for the recycled gases in heat exchange relation past the hot burner housing through an outlet opening 84 formed as part of upper wall opening 38 into the drum chamber. The recycled gas opening 84 is located immediately adjacent the burner combustion gas opening 67 to the drum chamber, and is downstream therefrom as referenced by the direction of rotation of the drum 14 and the passing drum wall. The divider wall 63 extends the full width of the inlet openings 67 and 84 and terminates in closely spaced proximity from the drum 14, and is almost at right angles to the circumferential drum wall.

Since the recycled air is brought in heat proximity with the extremely hot surfaces of the burner housing, it is heated thereby. It is preferable to recycle anywhere from 50 to 75 percent of the air flowing through the dryer so that where for example a 600 cubic feet per minute blower is used, a volume of only 200 cubic feet per minute of ambient air is circulated through the burner housing while there is 400 cubic feet of recycled air that is circulated past and over the burner housing and subsequently into the dryer. The percentage of recycled air is determined by the size of the recycle manifold relative to the area of the exhaust duct 58 and the exhaust duct size typically is set at the dryer manufacturer, although by means of adjustable stops (not shown) restricting full opening of the anti back flow damper 59 for example, this ratio of areas can be adjusted somewhat for flexible use of this recycled gas ratio.

Of extreme importance relative to the successful operation of this invention, is the proximity and sizing of the inlet openings to the drum chamber for the high temperature burner combustion gases and of the cooler although heated recycled gases, as determined by the openings 67 and 84 being on immediate opposite sides of the partition wall 63. The combustion gases at the throat of opening 67 are at approximately 600° to 750°F, and the recycled gases at the throat of opening 84 are between 200° and 300°F; and the combustion gases comprises approximately one third to one half the volume passing through the dryer or 200 cfm to 300 cfm while the recycled gases comprises approximately one half to two thirds the total air flow through the dryer unit or 300 cfm to 400 cfm. A most important aspect of the subject invention is the directional discharge of the gases from the openings 67 and 84 generally normally toward the circumferential drum wall, and the throat discharge effect that gives sufficiently high discharge velocity to penetrate the drum and minimize the nonbeneficial air slip of high-temperature gases around the drum between the drum exterior wall and the baffle walls 36 and 37. Some gas mixing takes place even before penetration into the drum, but nonetheless, thorough gas mixing and temperature blending takes place within the drum when the immediately adjacent gases are churned against or combined with one another upon drum rotation; and this minimizes possible scorching damage of the goods tumbling in the dryer. Based on the preferred recycled gas ratio and compensating for the differential gas temperatures at the respective discharge throats as above noted, the total throat area of the recycled gas opening 84 is approximately equal to the total throat area of the combustion gas opening 67.

In operation, the heated gases discharged initially to the dryer chamber are rapidly cooled by evaporation of moisture off the tumbling articles in the drum, particularly at the start of the drying cycle when the articles are with abundant moisture. After the articles begin to dry, the temperature of the exhausted gases rises and can, in fact, approach the temperature of the inlet gases to the drum chamber. A thermostat 90 is typically located in the air flow path adjacent the outlet opening 39 and is set at some adjustable temperature typically less than 200°F to turn off gas flow to the burner upon a sufficient buildup of heat, while allowing the blower and the drum rotation to continue. This minimizes possible damage to the goods by scorching or even fire.

Additionally, a secondary thermostat 92 can be used to sense the temperature in the exhaust duct just prior to the tee connection, and this thermostat can be set to operate at a few degrees higher than the primary thermostat 90 so that should the latter fail, the secondary thermostat 92 can, responsive to a sufficient rise in temperature, shut off the burner operation.

It will be noted that the exhausted gas duct at the tee junction between directing the gas either to the inlet to the reclaimer housing or to the outdoor atmosphere, is continuous and in a straight line path in the direction toward the reclaimer housing to induce a ram effect on such flow of the gases. This improves the recirculation efficiency of the exhausted gases to be reused since the main portion of same are recycled or reused while the portion that is actually dumped or discharged to outdoor atmosphere is at a right angle tee from the ram effect.

The air discharge guide walls 63, 66, and 80 are parallel to one another and generally in the direction normally toward the circumferential drum wall, and this gives directional impulses to the discharging heated gases. The sizing of these throat areas is designed also to generate ample normal velocity of such gases. The common divider wall 63 shared by each of the gas directing passages extends almost completely to the drum wall as does the corner edges of each of the other walls 66 and 80. All these factors minimize side slip, as it were, of the discharging input gases between the baffle wall 36 exteriorly of the drum and provide for good penetration through the perforated drum wall and into the drum interior.

What is claimed is:

1. A dryer comprising the combination of air baffle walls shaped in part to define a cylindrical drum chamber, a drum mounted for rotation in the drum chamber and having perforated cylindrical walls disposed in close proximity to the air baffle walls, a burner operable for combusting fuel with ambient air and a box shaped housing surrounding the burner and having wall structure for directing the combustion gases through an opening in one air baffle wall to the drum chamber, duct means for directing gases through an opening in the other air baffle wall from the drum chamber to the outdoor atmosphere, a tee connection in the duct means operable for diverting part of the gases therein for discharge other than to the outdoor atmosphere, a reclaiming housing having wall structure disposed in outwardly spaced adjacent relationship relative to the burner housing to define therebetween a tortuous passageway isolated from the combustion gases but in heat exchange relation therewith, manifold means for directing the diverted gases downstream of the tee to and only to the reclaiming housing passageway, said passageway wall structure terminating as an opening in the one air baffle wall immediately adjacent the opening therein for the combustion gases and downstream therefrom relative to the direction of rotation of the rotating drum and the burning housing and reclaiming housing wall structures including a common divider wall between said openings for the combustion gases and the diverted gases, and the latter mentioned wall structures further including opposing outer faces disposed parallel to one another and to the common wall and terminating just short of the cylindrical drum wall and being disposed approximately normal thereto for providing a directional discharge of the gases for penetration into the drum interior and minimal side slip of the gases around the drum.

2. A dryer combination according to claim 1, further including means to regulate the temperature of the combustion gases at the baffle wall opening to approximately 600° to 750°F and the reclaiming housing passageway being such as to heat the reclaimed gases at the baffle wall opening to approximately 200° to 300°F.

3. A dryer combination according to claim 2, wherein the reclaimed air constitutes approximately ½ to ⅔ of the total air flow through the dryer.

4. A dryer combination according to claim 1; wherein the manifold means is located adjacent the burner housing and includes a wall sloped to effectively change the interior cross section of the manifold means from its largest area at its inlet to its smallest area at its terminating end, and where such manifold means opens to a part of said passageway that is of relatively uniform cross section across a major portion of the burner housing.

* * * * *